United States Patent [19]

Stuck

[11] Patent Number: 4,686,925

[45] Date of Patent: Aug. 18, 1987

[54] ROTARY BOAT REPAIR APPARATUS

[76] Inventor: Andrew G. Stuck, 1190 Stead Dr., Menasha, Wis. 54952

[21] Appl. No.: 804,829

[22] Filed: Dec. 5, 1985

[51] Int. Cl.[4] ..... B63B 9/00

[52] U.S. Cl. ..... 114/224; 269/59; 269/106; 269/108; 414/762; 414/763; 414/765; 414/766

[58] Field of Search ..... 114/346, 221 R:222, 114/224, 26, 27, 31–33, 38, 48, 259; 414/426–429, 754, 758, 761–766, 911; 269/47, 55-61, 69, 71, 86, 87, 87.3, 104–108, 139, 152, 155, 156, 164, 165; 228/47, 48, 49.2; 248/185, 670, 671

[56] References Cited

U.S. PATENT DOCUMENTS

| | | | |
|---|---|---|---|
| 1,013,024 | 12/1911 | Lake | 114/79 W |
| 1,201,358 | 10/1916 | Schmitt | 114/359 |
| 1,507,911 | 9/1924 | Eichman | 269/99 |
| 1,792,612 | 1/1931 | Staley | 269/55 |
| 2,557,228 | 6/1951 | King | 414/765 |
| 2,984,364 | 5/1961 | Lamb | 414/765 |
| 3,190,461 | 6/1965 | Dostlewaite | 414/765 |
| 3,536,023 | 10/1970 | Toher | 114/259 |
| 3,868,101 | 1/1975 | Noazaki et al. | 269/25 |
| 4,039,115 | 8/1977 | Randolph | 228/44.5 |
| 4,202,539 | 5/1980 | Polastri | 269/70 |
| 4,204,494 | 5/1980 | Bridwell | 114/222 |
| 4,236,477 | 12/1980 | Norris | 114/222 |
| 4,491,307 | 1/1985 | Ellefson | 269/55 |

*Primary Examiner*—Joseph F. Peters, Jr.
*Assistant Examiner*—C. T. Bartz
*Attorney, Agent, or Firm*—Andrus, Sceales, Starke & Sawall

[57] ABSTRACT

An apparatus for repairing boat hulls comprising a rack mounted for rotation about a horizontal axis. A beam is cantilevered outwardly from the rack, and a hoist mechanism is mounted for travel on the beam. A boat resting on a trailer is moved partially within the rack and the hoist mechanism located on the cantilevered end of the beam elevates the boat from the trailer. The hoist mechanism is then moved along the beam to position the boat within the rack. A series of hull clamping braces that are connected to the rack are positioned in engagement with the hull and complement the shape of the hull. The boat is lowered onto the hull braces, and a series of upper clamping braces that are connected to the rack are brought into engagement with the upper surface of the hull to clamp the boat to the rack. In some cases, side clamping assemblies can also be used to clamp the sides of the hull to the rack. By rotating the rack, the hull can be inverted so repairs or modifications can be readily made on the hull.

14 Claims, 9 Drawing Figures

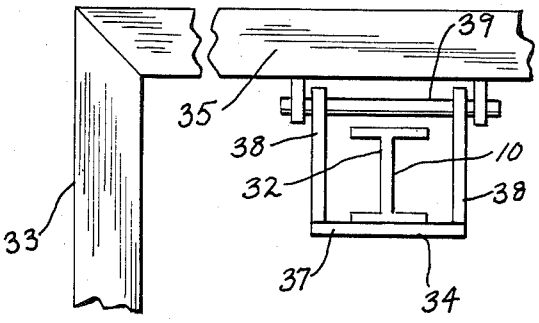
FIG. 3
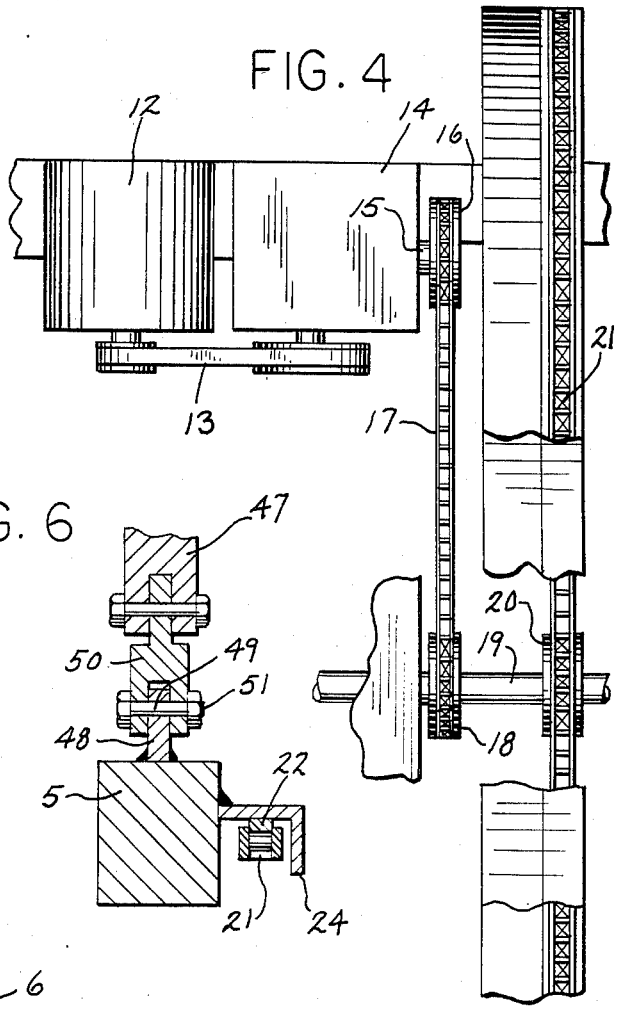
FIG. 4
FIG. 6
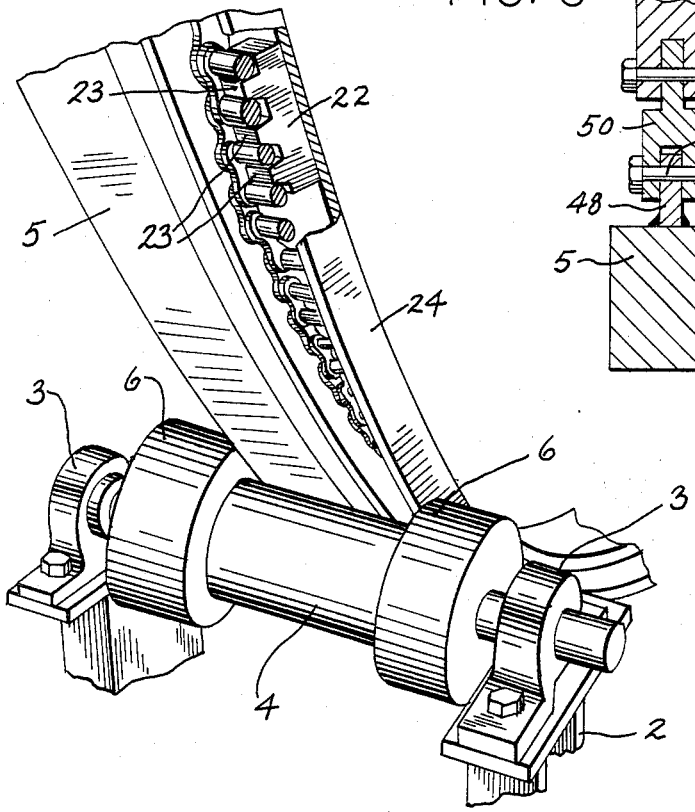
FIG. 5
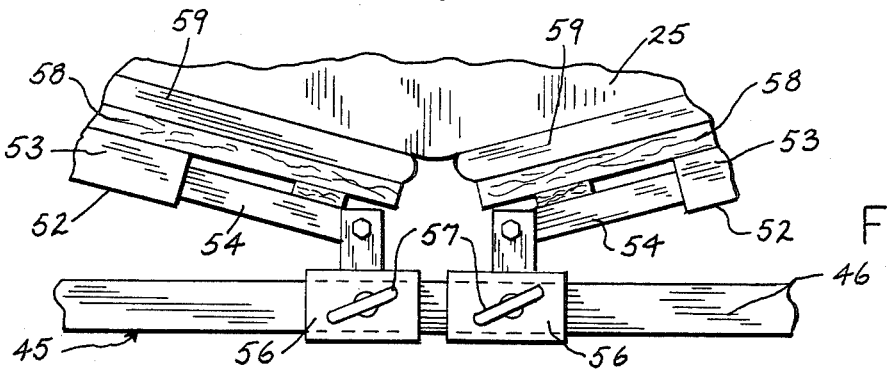
FIG. 9

FIG. 7
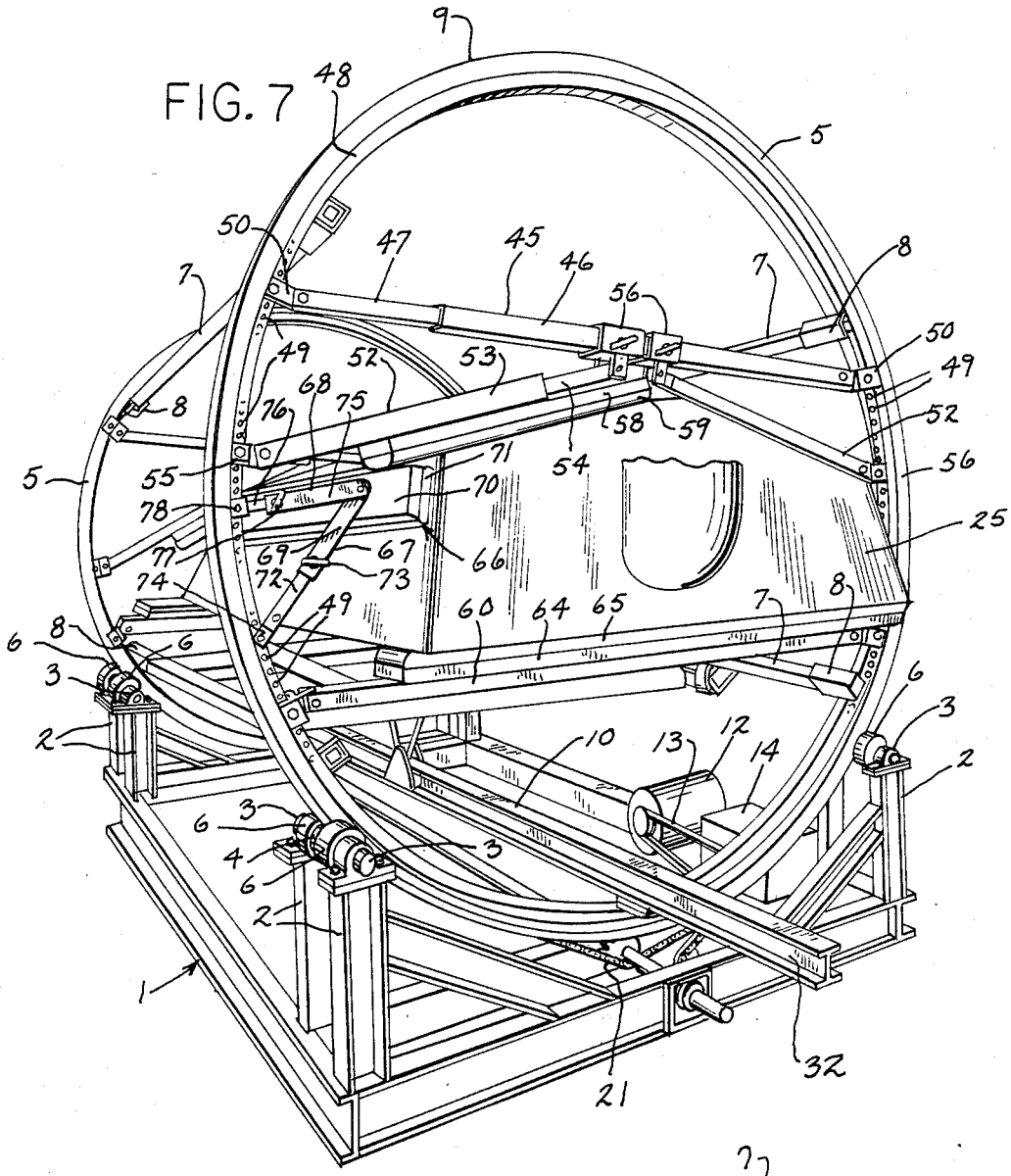
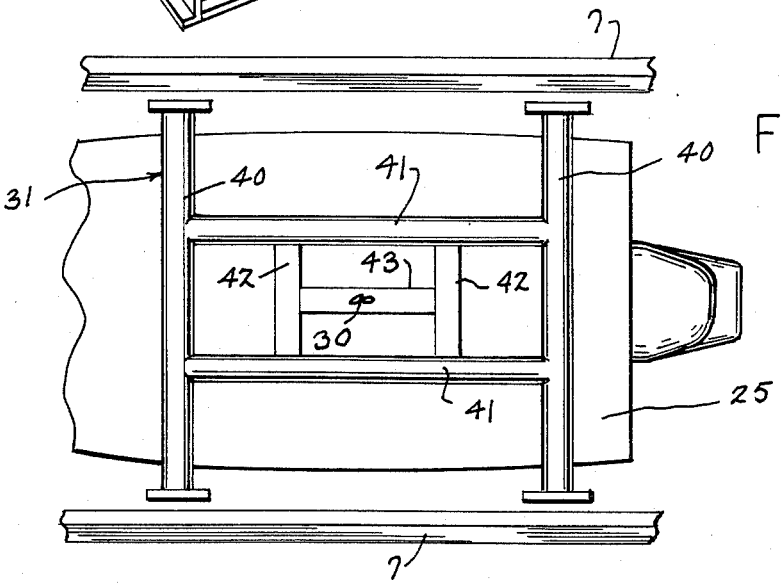
FIG. 8

ROTARY BOAT REPAIR APPARATUS

BACKGROUND OF THE INVENTION

Repairing damage to the hulls of fiber glass boats has been a difficult and expensive procedure. If the hull is maintained in an upright position during the repairing operation, the damaged area will normally be in a relatively inaccessible location, requiring the workman to work at a position above his head in order to repair the damage. Not only is this an awkward position, but gravity works against the repair with the result that only one layer of fiber glass can be applied at a time to the damaged area and the liquid resin tends to drip downwardly. Thus, repairs to boat hulls are tedious and time consuming operations and the repair is often unattractive in appearance.

In an attempt to facilitate working on the hull, the practice in the past has been to invert the boat hull by hoisting it with a crane or other hoist mechanism and rolling it over onto a pile of automobile tires. Turning the boat onto a side edge is not satisfactory, for the side edge normally does not have sufficient strength to support the boat and damage can result. However, to invert the boat it is necessary to remove the motor, windshield and other hardware from the boat before it can be inverted onto the tires. In addition, it normally requires several workmen to aid in positioning the boat hull as it is lifted and inverted by the crane. After inverting, the damaged area may not be precisely upright, with a result that the liquid resin may tend to drip from the damaged area.

Under this conventional procedure, after the repair has been completed, it is necessary to right the boat hull through use of a crane or other hoist and replace the windshield, motor and other hardware.

SUMMARY OF THE INVENTION

The invention is directed to an apparatus for repairing boat hulls which will enable the boat hull to be inverted to any desired position to facilitate repairs to the damaged area.

In accordance with the invention, the apparatus includes a rack which is mounted for rotation about a horizontal axis, and a beam is mounted longitudinally on the rack and is cantilevered outwardly beyond the end of the rack.

Mounted for travel on the beam is a hoist mechanism, and a boat resting on a trailer is moved partially within the rack and under the hoist mechanism on the cantilevered end of the beam. Slings attached to the hoist are then engaged with the boat and the boat is lifted from the trailer and the hoist mechanism is then moved along the beam to position the boat within the rack.

A series of lower hull clamping braces that are connected to the rack are then positioned in engagement with the lower surface of the hull and complement the shape of the hull. The boat is then lowered on to the braces, and a series of upper clamping braces, that are connected to the rack, are brought into engagement with the upper surface of the hull to securely clamp the boat hull to the rack. Air bags can be associated with the clamping braces to cushion and protect the hull. With some hull designs, side clamping braces can also be used.

By rotating the rack, the hull can be inverted to any position so that repairs or modifications can be readily made on the hull.

With the boat repairing apparatus of the invention, the hull can be rotated so that the damaged area faces upwardly in position for most efficient repair work.

The rack is designed to accommodate hulls of various sizes and designs and it is not always necessary to remove the motor, windshield or other hardware from the boat hull during the repair operation.

As a further advantage, the entire apparatus can be readily disassembled for shipment and storage.

Other objects and advantages will appear in the course of the following description.

DESCRIPTION OF THE DRAWINGS

The drawings illustrate the best mode presently contemplated of carrying out the invention.

In the drawings:

FIG. 3 is enlarged fragmentary end view showing the support for the cantilevered end of the beam;

FIG. 4 is a plan view showing the drive mechanism for rotating the rack;

FIG. 5 is perspective view showing the rack and chain drive mechanism with parts broken away in section;

FIG. 6 is a transverse section of the drive ring;

FIG. 7 is perspective view showing the boat hull in the inverted position in the rack;

FIG. 8 is a plan view of the hoist frame; and

FIG. 9 is an enlarged fragmentary end view showing the lower supporting braces for the hull.

DESCRIPTION OF THE ILLUSTRATED EMBODIMENT

Figure 1:
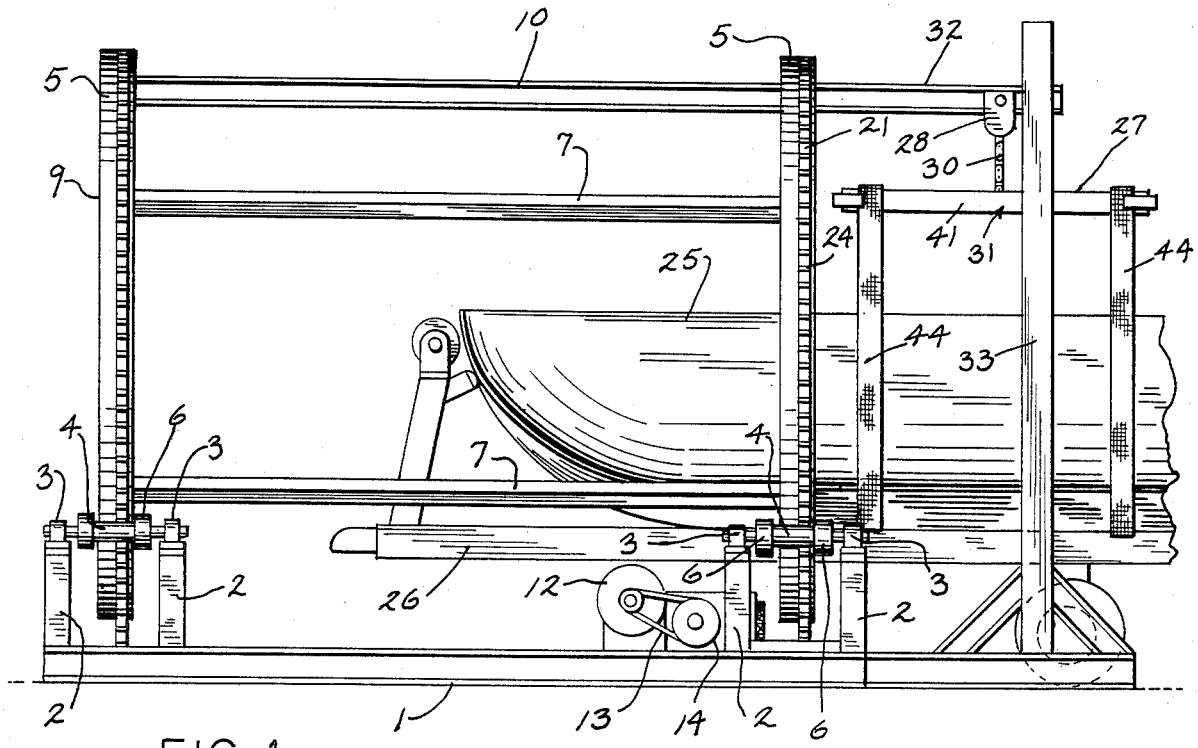
FIG. 1 is a side elevation of the boat repair apparatus showing a boat on a trailer positioned partially within the rotatable rack.

The boat repair apparatus of the invention includes a generally rectangular frame or supporting structure 1 which is mounted on the ground or foundation, and a pair of parallel columns 2 extend upwardly from each corner of frame 1 and support bearing blocks 3 which journal rollers 4. Rings 5, located at the front and rear ends of the frame, are journaled on corresponding pairs of rollers 4. As best shown in FIG. 5, each roller 4 is provided with a pair of end flanges or collar 6 which maintain the rings 5 in proper alignment on the rollers.

Rings 5 are tied together by longitudinal braces 7. Stub tubes 8 are welded to the inner surfaces of rings 5 and braces 7 are removably secured within the aligned tubes 8 by bolts. Rings 5, in conjunction with braces 7, constitutes a rotatable rack, indicated generally by 9.

An I-beam 10 is connected to rings 5 and is cantilevered outwardly beyond the end of the rack 9, as best illustrated in FIG. 1. To connect beam 10 to rings 5, plates 11 are welded to the inner surfaces of the respective rings 5 and the flanges of the I-beam 10 are bolted to plates 11.

To rotate rack 9 relative to frame 1, a motor 12 is mounted on the frame and the drive shaft of motor 12 is connected through belt drive 13 to the input shaft of a gearbox 14. Output shaft 15 of gearbox 14 carries a sprocket 16 which is connected through chain 17 to sprocket 18. The sprocket 18 is mounted on shaft 19 which also carries a sprocket 20, and a drive chain 21 is connected with sprocket 20 and is driven thereby. Shaft 19 extends the length of rack 9 and also drives a second chain 21 which is associated with the rear ring 5.

Each drive chain 21 extends completely around the circumference of the respective ring 5 and is engaged with gear segments 22 which are mounted in spaced relation on the side surface of ring 5. Each gear segment 22, as best shown in FIG. 5, includes several teeth 23 that are engaged with chain 21. An angle-shaped shield 24 is also secured to the ring and extends around the outer surface of the gear segments 22. With this drive construction, operation of motor 12 will drive the chains 21 to thereby rotate the rack 9 about its horizontal axis.

FIG. 1 shows the manner in which a boat 25 having a damaged hull is introduced into the rotary rack 9. Boat 25, carried on a conventional trailer 26, is moved partially into rack 9 with the tongue of the trailer facing inwardly of the rack. A hoist mechanism 27 located on the cantilevered end of beam 10 is then employed to lift boat 25 from trailer 26 and move the boat inwardly of the rack 9. Hoist 27 includes a trolley 28 having two pair of rollers 29 which are adapted to ride on the lower flanges of beam 10. A conventional chain hoist 30 connects trolley 28 with a hoist frame 31.

As best shown in FIGS. 1 and 3, the outer cantilevered end 32 of beam 10 is supported during the boat lifting operation by a generally U-shaped frame 33 which is spaced outwardly from the end of rack 9 and is connected to frame 1. A pivotable bracket 34, as shown in FIG. 3, is connected to the upper horizontal header 35 of U-shaped frame 33. Bracket 34 includes a supporting plate 37 which is carried by a pair of legs 38, and the upper ends of legs 38 are pivoted to a shaft 39 carried by header 35. With bracket 34 in its lowered position the cantilevered end 32 of beam 10 will be supported on plate 39. The pivotable connection of the bracket 34 to frame 33 enables the bracket to be pivoted upwardly to permit the rack 9 and beam 10 to be rotated relative to frame 33.

As best shown in FIG. 8, hoist frame 31 includes a pair of spaced transverse members 40 which extend transversely of the boat hull when the boat hull is mounted in rack 9. Transverse members 40 are connected by longitudinal members 41, and a pair of connecting members 42 are connected between longitudinal members 41. Located parallel to members 41 is a central member 43 which is connected between members 42 and hoist chain 30 is connected to central member 43.

Slings 44 of conventional construction are removably connected to the ends of side members 40 and the slings can be manually positioned under the hull of boat 25 so that the boat can be lifted from trailer 26. Slings 44 can be adjustable in length to accommodate various hull configurations.

With the boat 25 partially inside of rack 9, as shown in FIG. 1, hoist mechanism 27 is moved outwardly onto the cantilevered end 32 of beam 10 and slings 44 are then wrapped under the boat hull. Hoist frame 31 is then lifted through operation of chain hoist 30 to thereby lift boat 25 from the trailer and the trailer can then be removed from the rack. Trolley 28 is then moved inwardly along beam 10 to align boat 25 within rack 9.

Once boat 25 has been moved into rack 9 and the trailer is removed, the boat is clamped to the rack so that the rack can be rotated to invert the boat. The clamping mechanism includes braces 45 which are positioned chordwise across the respective rings 5 beneath the boat hull. Each brace 45 is telescopic and includes an outer section 46 and an inner section 47. The ends of both sections 46 and 47 are connected to the respective ring 5.

The connection of brace 45 to ring 5 is best illustrated in FIG. 6. Strip 48 is welded edgewise to the inner surface of ring 5 and is formed with a plurality of holes 49 which are spaced around the circumference of the ring. A clevis 50 is attached to the end of each section 46,47, and clevis 50 is connected through bolt 51 to one of the holes 49 in strip 48. As the strip 48 is provided with a plurality of holes 49 which extend around the circumference of the ring, the position of brace 45 can be varied depending upon the configuration of the boat hull.

A pair of diagonal braces 52 connect the central portion of each brace 45 with ring 5. Each brace 52 is telescopic and includes an outer section 53 and an inner section 54 slidable in outer section 53. The end of outer section 53 is connected to ring 5 through a clevis 55, similar in construction to clevis 50, while the end of inner section 54 is pivotally connected to a tube 56 which is freely slidable on outer section 46 of cross brace 45. Each tube 56 can be locked to brace 45 by means of a handle operated set screw 57.

To provide additional surface area for supporting the boat hull, a board 58 can be mounted on the braces 52, and inflatable air bags 59 can be secured to the upper surfaces of boards 58. Air bags 59 serve to cushion the boat hull and protect the surface of the hull during the repair operation.

Braces 45 and 52 are associated with each of the rings 5 so that the boat hull will be supported at both its bow and stern ends.

With braces 45 and 52 in place, the boat, which is supported by hoist frame 31, is lowered onto the air bags 59. Slings 44 are then removed and hoist frame 31 is raised and attached through ropes or tie downs to rack 9 so that the hoist frame will not swing during rotation of the rack.

With the boat hull supported on braces 45 and 52, a pair of upper braces 60 are positioned in engagement with the upper surface of the boat hull. Each upper brace 60 is telescopic and includes an outer section 61 and an inner section 62 which is slidable within outer section 61. The ends of sections 61 and 62 are connected to the ring 5 through clevises 63, similar in construction to clevis 50.

To cushion and protect the boat, a board 64 and air bag 65 can be positioned between brace 60 and the boat. The air bags 59 and 65 are inflated after the braces 45, 53 and 60 are in place to thereby firmly clamp the boat hull to the braces.

Figure 2:
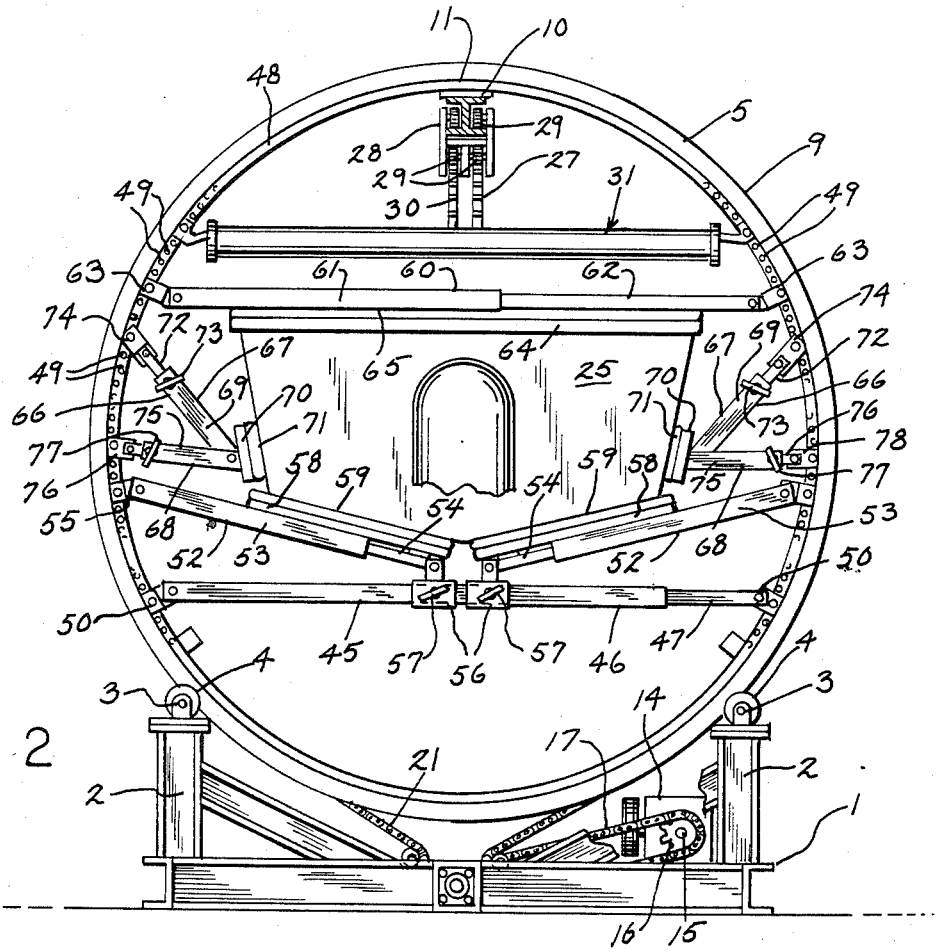
FIG. 2 is an end view showing the boat clamped within the rack.

Certain hull designs have a relatively shallow V-shape at the stern, and with hulls of this design a pair of side clamp assemblies 66 can be employed to prevent slippage of the hull as it is rotated. Each assembly 66 includes a pair of telescopic braces 67 and 68 that interconnect the ring 5 with the side of the boat hull 25, as shown in FIG. 2.

Brace 67 is composed of a member 69 that is pivotally connected to board 70 which, in turn, carries an inflatable air bag 71 that is engaged with hull 25. A second brace member 72 is slidable within member 69 and the two brace members 69 and 72 can be locked together by handle operated set screw 73.

The outer end of brace member 72 carries a clevis 74 which is connected by a bolt to one of the holes 49 in strip 48, in the manner previously described.

Similarly, brace 68 consists of a brace member 75 that is pivotally connected to board 70, and a second brace member 76 is slidable within member 75. The two members 75 and 76 can be locked together by handle-operated set screw 77. Mounted on the outer end of brace member 76 is a clevis 78 that is connected though a bolt to one of the holes 49.

Clamping assemblies 66 are positioned in engagement with the sides of the boat hull 25 at the stern of the hull and act to prevent side-slipping of the hull as the hull is rotated with the rack. However, if the hull has a prominent V-shape at the stern, braces 53 will be at a substantial angle to brace 45, and in this situation braces 53 will prevent side slippage so that the side clamping assemblies may not be required.

With the hull firmly clamped, the rack 9 can be rotated through operation of motor 12 to position any portion of the hull in an upright manner to facilitate repair of the damaged area of the hull. The damaged area can be faced upwardly in a position for most effective repair work.

The braces 45, 53 and 60 enable boat hulls of various sizes and configurations to be firmly clamped to the rotary rack.

As a further advantage, the boat can be clamped to the rack and the repair made without the necessity of not always removing the outboard motor or stern drive or removing the windshield and other hardware from the boat. This substantially simplifies the overall repair operation.

As the components of the rack and the braces are removably connected, the entire apparatus can be broken down for shipment or storage.

While the rack 9 is shown in the drawings as being composed of a pair of spaced rings 5 it is contemplated that the rotary rack can include any number of rings or could be a cylindrical shell, although access to the damaged area of the hull may be somewhat restricted if the rack is in the form of a cylindrical shell.

Various modes of carrying out the invention are contemplated as being within the scope of the following claims particularly pointing out and distinctly claiming the subject matter which is regarded as the invention.

I claim:

1. A rotary boat repair apparatus, comprising a rack having a generally horizontal axis and an open end, means for mounting the rack for rotation about said axis, drive means for rotating said rack, hoist means for positioning a boat longitudinally within said rack, first clamping means interconnecting the lower surface of the boat hull and said rack, second clamping means interconnecting the upper surface of the boat hull and said rack, and means for adjustably connecting both said first and second clamping means to said rack, said first clamping means including a first brace extending chordwise of said rack, a second brace connecting the rack to the central portion of said first brace and complementing the bottom surface of the boat hull, and a third brace connecting the rack to the central portion of said first brace and complementing the bottom surface of said hull, said second and third braces being disposed in a generally V-shaped arrangement, clamping of said boat hull to the rack through operation of said first and second clamping means enabling the rack to be rotated to thereby position the hull at any desired inclination.

2. The apparatus of claim 1, wherein said drive means includes an endless member disposed around the periphery of said rack, and power operated means for driving said endless member in an endless path.

3. The apparatus of claim 1, wherein said braces are telescopic.

4. The apparatus of claim 1, wherein said braces are adjustably mounted to said rack.

5. The apparatus of claim 1, wherein said rack comprises a pair of spaced rings and a plurality of support members extending parallel to said axis and connecting said rings.

6. The apparatus of claim 1, wherein said second and third braces extend at an acute angle with respect to said first brace.

7. The apparatus of claim 2, wherein said rack includes a generally circular ring, said endless member comprises a chain, and said drive means also includes sprocket means mounted on said ring and engaged with said chain.

8. The apparatus of claim 1, and including cushioning means carried by said second and third braces and disposed to engage the hull of said boat.

9. The apparatus of claim 8, wherein said cushioning means comprises an inflatable gas bag.

10. The apparatus of claim 1, and including third clamping means interconnecting the sides of the boat hull with the rack.

11. A rotary boat repair apparatus, comprising a rack having a generally horizontal axis and an open end, means for mounting the rack for rotation about said axis, drive means for rotating said rack, means for positioning the boat longitudinally within said rack, a support member of extendable length disposed chordwise of said rack, a first brace having an outer end adjustably connected to said rack, a second brace having an outer end adjustably connected to said rack, means for mounting the inner end of each brace for sliding movement on the central portion of said support member, said braces being constructed and arranged to engage the bottom surface of the hull of a boat, and clamping means constructed and arranged to engage the upper surface of the hull of the boat for clamping said hull to the rack.

12. The apparatus of claim 11, wherein each brace has a generally flat upper surface, and an inflatable bag disposed on said upper surface to support and protect the hull of said boat.

13. A rotary boat repair apparatus, comprising a rack having a generally horizontal axis and an open end, said rack including at least one annular member, means for mounting the rack for rotation about said axis, drive means for rotating said rack, means for positioning a boat longitudinally within said rack, first clamping means interconnecting the lower surface of the boat hull and said rack, said first clamping means including a first brace extending chordwise cross said annular member, a second brace having an inner end connected to the central portion of said first brace, a third brace having an inner end connected to the central portion of said first brace, a plurality of first fastening elements disposed on said annular member and spaced along the periphery of said annular member, second fastening elements on the ends of said braces, said braces being telescopic in length, selective engagement of said first fastening elements with said second fastening elements permitting an adjustment of the position of said braces relative to said rack to accommodate boat hulls of various sizes and configurations, and second clamping means constructed and arranged to engage the upper surface of the boat hull and clamp said hull to said rack.

14. The apparatus of claim 13, wherein said first fastening elements are holes and said second fastening elements are pivotally connected to said braces and are engageable with said holes.

* * * * *